US011357380B2

(12) United States Patent
Zhu et al.

(10) Patent No.: US 11,357,380 B2
(45) Date of Patent: Jun. 14, 2022

(54) CLEANING TOOL

(71) Applicant: JIAXING JACKSON TRAVEL PRODUCTS CO., LTD, Jiaxing (CN)

(72) Inventors: Xuelin Zhu, Jiaxing (CN); Danjun Chi, Jiaxing (CN)

(73) Assignee: JIAXING JACKSON TRAVEL PRODUCTS CO., LTD, Jiaxing (CN)

( * ) Notice: Subject to any disclaimer, the term of this patent is extended or adjusted under 35 U.S.C. 154(b) by 0 days.

(21) Appl. No.: 17/168,209

(22) Filed: Feb. 5, 2021

(65) Prior Publication Data

US 2021/0251456 A1 Aug. 19, 2021

(30) Foreign Application Priority Data

Feb. 14, 2020 (CN) ..... 202010092851.9

(51) Int. Cl.
*A47L 11/282* (2006.01)
*A47L 13/20* (2006.01)
*A47L 13/144* (2006.01)

(52) U.S. Cl.
CPC ..... *A47L 13/144* (2013.01); *A47L 11/282* (2013.01); *A47L 13/20* (2013.01)

(58) Field of Classification Search
CPC ..... A47L 11/282; A47L 13/144; A47L 13/20
See application file for complete search history.

(56) References Cited

U.S. PATENT DOCUMENTS 1,949,461 A * 3/1934 Fatland ..... A47L 13/144 15/119.1
2,955,309 A * 10/1960 Brown, Jr. ..... A47L 13/144 15/119.2
2009/0158542 A1* 6/2009 Noble ..... A47L 13/20 15/147.1

FOREIGN PATENT DOCUMENTS

CN 207236751 U 4/2018
CN 210961797 U 7/2020

* cited by examiner

*Primary Examiner* — Randall E Chin
(74) *Attorney, Agent, or Firm* — Bayramoglu Law Offices LLC

(57) ABSTRACT

A cleaning tool is provided. The cleaning tool includes a first roller, a second roller, a shell and a wiper. The first roller is rotatably connected to the shell. The second roller is rotatably connected to the shell. Two ends of the wiper are wound around the first roller and the second roller, respectively. The cleaning tool further includes an operation part and a link part. The operation part moves in an axial direction of the first roller to control the link part to unlock the second roller and the operation part rotates to drive the first roller to rotate. Unlocking of the second roller and rotation of the first roller and the second roller are controlled by different motions of the operation part.

20 Claims, 4 Drawing Sheets

CLEANING TOOL

CROSS REFERENCE TO THE RELATED APPLICATIONS

This application is based upon and claims priority to Chinese Patent Application No. 202010092851.9, filed on Feb. 14, 2020, the disclosure of which is incorporated herein by reference in its entirety.

TECHNICAL FIELD

The invention relates to the field of household cleaning tools, in particular to a cleaning tool.

BACKGROUND

With people's increasing requirements for cleanliness and sanitation, wipers on cleaning heads of many household cleaning tools such as mops, cleaning brushes, window cleaners and sweepers are disposable. According to one cleaning tool, two rollers are rotatably connected to a head assembly, and two ends of a disposable wiper are wound around the two rollers respectively, so that a dirty wiper can be replaced with a clean one by rotating the rollers, and the wiper can be used for cleaning when the rollers are locked.

For example, Chinese Utility Model Patent Application No. CN201720458369.6 discloses a mop with an adjustable cleaning surface, and Chinese Utility Model Patent Application No. CN201920735367.6 discloses a mopping tool. All these designs will face the problem of locking/unlocking and rotation of rollers, that is, when a dirty wiper is to be replaced with a clean one, the roller should remain in a rotatable state, otherwise, the wiper will not be rotated to be changed; when the cleaning tool is used for cleaning, the rollers should remain in a static state, otherwise, the wiper will slide and come loose. Hence, how to realize locking/unlocking and rotation of the rollers more effectively has become an issue to be settled for such cleaning tools.

SUMMARY

The objective of the invention is to overcome the above-mentioned defects of the prior art by providing a cleaning tool.

The technical solution adopted by the invention to settle the aforesaid problems is to provide a cleaning tool, comprising a first roller, a second roller, a shell and a wiper, wherein the first roller is rotatably connected to the shell, the second roller is rotatably connected to the shell, and two ends of the wiper are wound around the first roller and the second roller, respectively; the cleaning tool further comprises an operation part and a link part, and the operation part moves in an axial direction of the first roller to control the link part to unlock the second roller and rotates to drive the first roller to rotate.

Furthermore, the link part is rotatably connected to the shell; when the second roller is locked, a first end of the link part acts on the second roller; and the operation part acts on a second end of the link part to unlock the second roller.

Furthermore, the second end and/or the operation part are/is provided with a slope; the operation part applies a force to the link part, the second end drives the link part to rotate under the effect of the slope, and the first end unlocks the second roller.

Furthermore, the cleaning tool further comprises a first elastic part, wherein the first elastic part applies a force to the operation part to enable the operation part to return.

Furthermore, the operation part is elastic and returns by means of self elasticity.

Furthermore, the cleaning tool further comprises a second elastic part, wherein the second elastic part is connected to the shell and the link part and applies a force to the link part to enable the link part to lock or unlock the second roller.

Furthermore, the cleaning tool further comprises a rotary knob, wherein the rotary knob is rotatably connected to the shell on one side of the first roller, and the rotary knob and the shell are limited in the circumferential direction;

When a force is applied to the rotary knob, the rotary knob pushes the operation part to move towards the first roller or drives the operation part to rotate.

Furthermore, the rotary knob and/or the operation part are/is provided with a slope; and when the rotary knob rotates, the operation part moves in the axial direction of the first roller under the effect of the slope, so as to trigger the link part.

Furthermore, the rotary knob is circular and is provided with a first protrusion, and the operation part is provided with a second protrusion;

The shell is connected to an anti-rotation groove, and the operation part is provided with anti-rotation protrusions;

The anti-rotation protrusions are embedded in the anti-rotation groove; when the rotary knob rotates, the operation part moves linearly away from the rotary knob under the effect of the slope; the anti-rotation protrusions disengage from the anti-rotation groove, the rotary knob continues to rotate, the first protrusion pushes against the second protrusion, and the rotary knob drives the operation part to rotate.

Furthermore, the anti-rotation protrusions are gear teeth formed on an outer edge of the operation part, and tooth sockets corresponding to the gear teeth on the outer edge of the operation part are formed in the anti-rotation groove.

Furthermore, the first roller rotates with respect to the shell in one direction.

Furthermore, a ratchet unidirectional movement mechanism is arranged between the first roller and the shell and comprises a ratchet and a first pawl, and the first pawl rotates along the ratchet.

Furthermore, a round hole is formed in a side wall of the shell, the ratchet is circumferentially arranged along the round hole, and the first pawl is fixedly connected to the first roller and is surrounded by the ratchet.

Furthermore, the first pawl comprises an arc piece and a disk, wherein the arc piece is fixedly arranged on the periphery of the disk, a sharp tooth is formed at a far end of the arc piece, and the disk is fixedly connected to the first roller.

Furthermore, a ratchet unidirectional movement mechanism is arranged between the first roller and the shell and comprises a ratchet and a first pawl, the first pawl rotates along the ratchet, and tooth sockets of the ratchet correspond to the tooth sockets of the anti-rotation groove.

Furthermore, the shell is provided with a pawl elastic part and a second pawl, and the pawl elastic part forces the second pawl to abut against the gear teeth formed on the outer edge of the operation part.

Furthermore, the shell is provided with a pawl elastic part and a second pawl, the pawl elastic part forces the second pawl to abut against the gear teeth formed on the outer edge of the operation part, and tooth sockets of the second pawl are identical with the tooth sockets of the anti-rotation groove.

Furthermore, a gear is arranged at one end of the second roller, and a tooth surface engaged with the gear is formed at the first end.

Furthermore, a circular shaft is arranged at an end, away from the link part, of the second roller, a slot allowing the circular shaft to fall therein is formed in the shell, and the circular shaft is able to rotate in the slot; and an elastic block is arranged on the shell, and an abutting surface is formed between the elastic block and a side wall of the circular shaft.

Furthermore, the shell is provided with a hole, a button and a third elastic part; a drive rod to be embedded in the hole, and a fourth elastic part are arranged at one end of the first roller; the other end of the first roller is rotatably connected to the other side of the shell; the button pushes against the drive rod; the drive rod is movably arranged in an axial direction of its own, and the fourth elastic part abuts against the drive rod; and the button is movably arranged in an axial direction of its own, and the third elastic part abuts against the button;

When the first roller is mounted in the shell, the drive rod moves towards the hole, and the fourth elastic part is compressed until the drive rod is embedded in the hole and then rebounds to push against the button; when a force is applied to the button, the button pushes against the drive rod, and the fourth elastic part is compressed until the drive rod disengages from the hole.

According to the cleaning tool provided by the invention, unlocking of the second roller and rotation of the first roller and the second roller can be controlled by means of different motions of the operation part, so that the operation process is simplified, and the cleaning tool can be used by users easily.

BRIEF DESCRIPTION OF THE DRAWINGS

Specific implementations of the invention will be explained in further detail below in conjunction with accompanying drawings.

REFERENCE SIGNS

Figure 1:
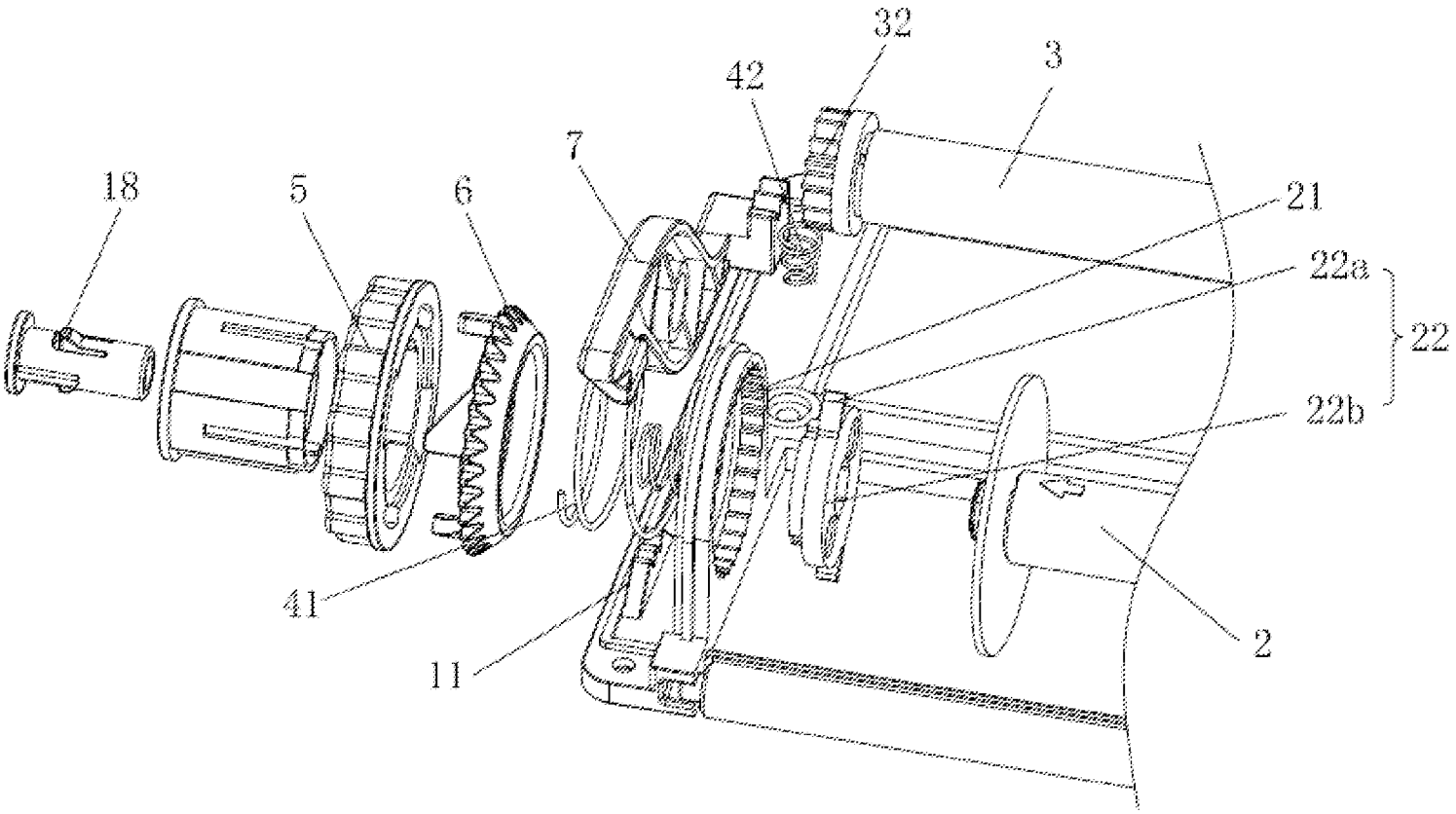
FIG. 1 is an exploded view of a first implementation of the invention (a shell is not shown)
Figure 2:
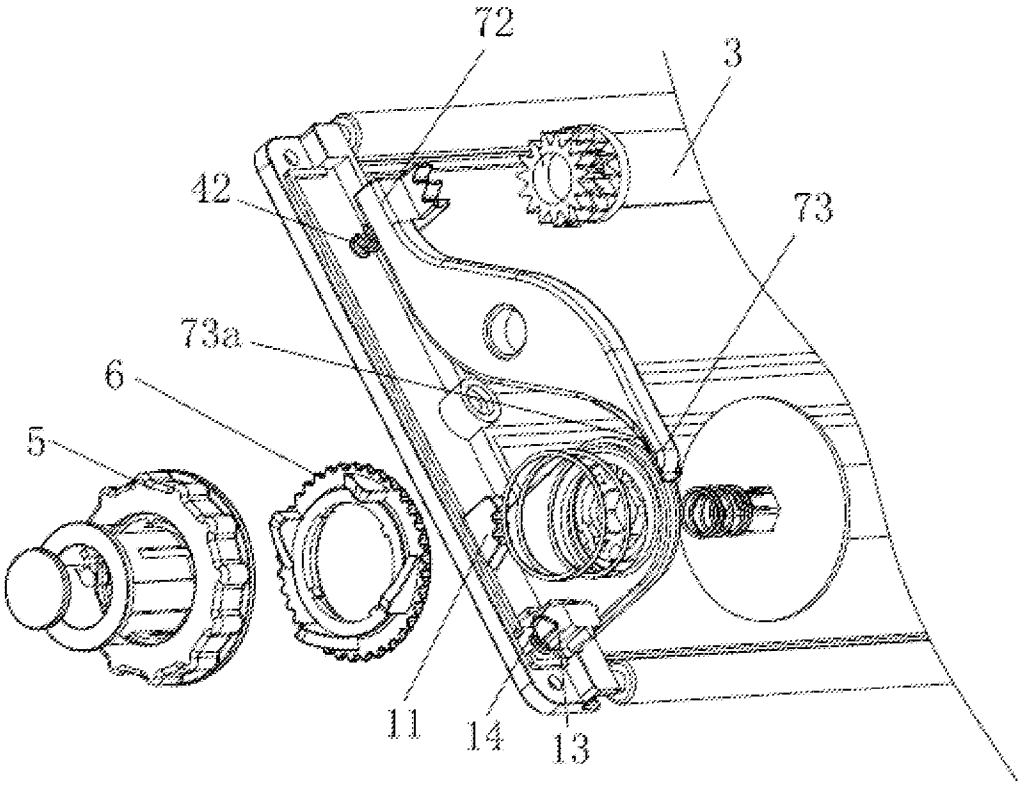
FIG. 2 is an exploded view of a second implementation of the invention (a shell is not shown)
Figure 3:
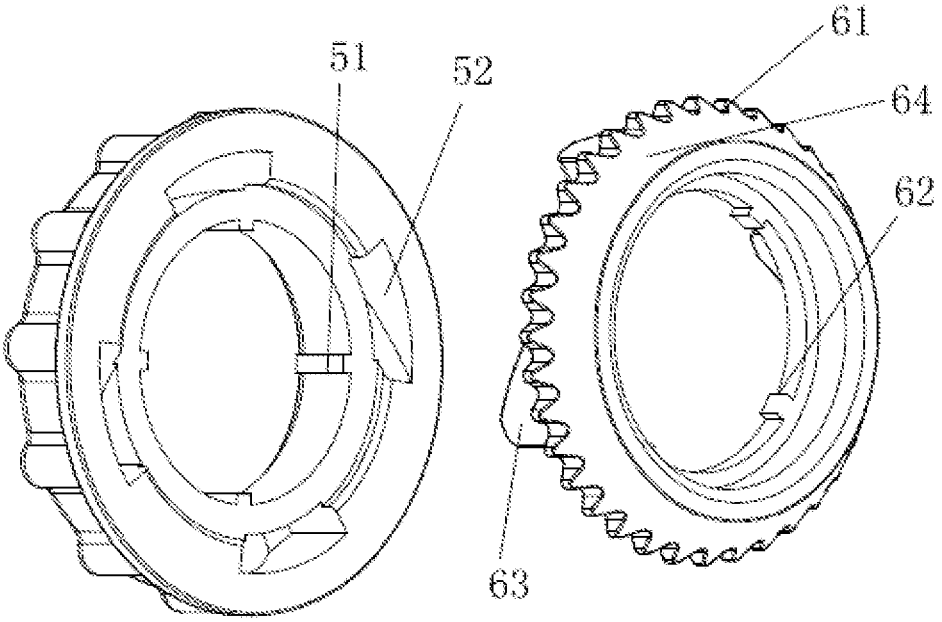
FIG. 3 is an exploded view of a rotary knob and an operation part of the invention.
Figure 4:
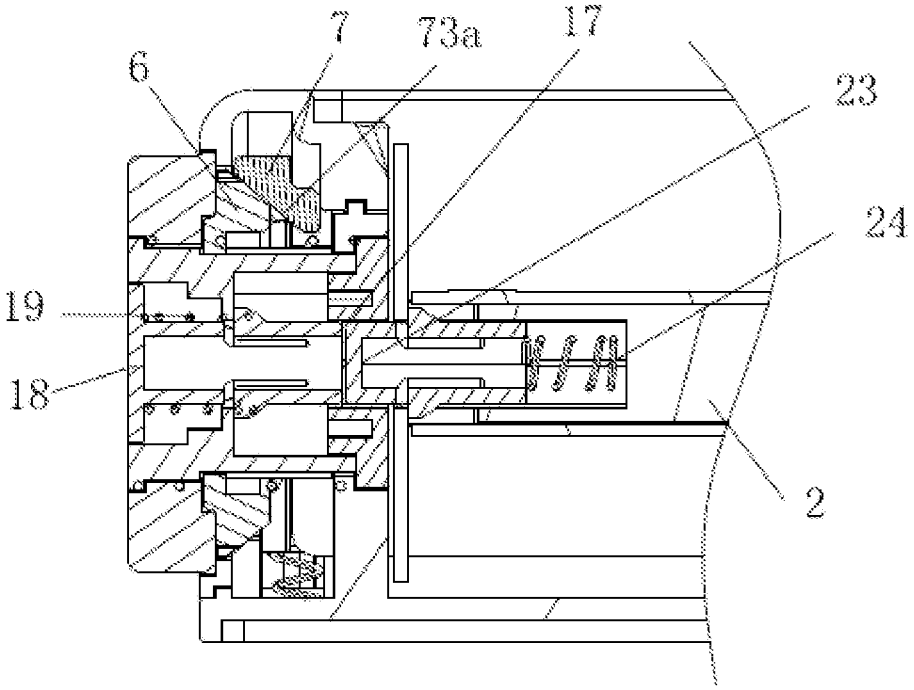
FIG. 4 is a sectional view from one perspective of the invention.

1, shell; 11, anti-rotation groove; 13-pawl elastic part; 14, second pawl; 15, slot; 16, elastic block; 17, hole; 18, button; 19, third elastic part; 2, first roller; 21, ratchet; 22, first pawl; 22*a*, arc piece; 22*b*, disk; 23, drive rod; 24, fourth elastic part; 3, second roller; 31, circular shaft; 32, gear; 41, first elastic part; 42, second elastic part; 5, rotary knob; 51, first protrusion; 52, slope; 6, operation part; 61, anti-rotation protrusion; 62, second protrusion; 63, slope; 64, abutting end; 7, link part; 72, first end; 73, second end; 73*a*, slope.

DETAILED DESCRIPTION OF THE EMBODIMENTS

To gain a better understanding of the purposes, technical solutions and advantages of the invention, the invention will be described in further detail below in conjunction with the accompanying drawings and embodiments. It should be understood that the specific embodiments in the following description are merely used to explain the invention, and are not intended to limit the invention.

As shown in FIG. 1-FIG. 5, the invention provides a cleaning tool which comprises a first roller 2, a second roller 3, a shell 1, an operation part 6, a link part 7 and a wiper. The first roller 2 is rotatably connected to the shell 1, and the second roller 3 is rotatably connected to the shell 1. Two ends of the wiper are wound around the first roller 2 and the second roller 3, respectively. The operation part 6 moves in an axial direction of the first roller 2 to control the link part 7 to unlock the second roller 3. In this embodiment, "the operation part 6 moves in the axial direction of the first roller" includes, but is not limited to, the case where the direction of movement of the operation part 6 is coaxial with the axial direction of the first roller, and also includes the case where the direction of movement of the operation part 6 is parallel to the axial direction of the first roller 2. The operation part 6 can rotate to drive the first roller 2 to rotate, and the wiper drives the second roller 3 to rotate. In this embodiment, when operating the operation part 6, a user pushes the operation part 6 to move in the axial direction of the first roller 2 at first to unlock the second roller 3 and then operates the operation part 6 to rotate to drive the first roller 2 to rotate.

According to the cleaning tool of the invention, unlocking of the second roller 3 and rotation of the first roller 2 and the second roller 3 can be controlled by means of different motions of the operation part 6, so that the operation process is simplified, and the user can use the cleaning tool easily.

Wherein, the operation part 6 moves in the axial direction of the first roller 2 to control the link part 7 to unlock the second roller 3. The "control" not only includes the case, in this embodiment, where the operation part 6 directly acts on the link part 7 to unlock the second roller 3, but also includes a below-mentioned case where an abutting end 64 pushes against a slope 73*a* to unlock the second roller 3, as well as a case where the operation part 6 does not act or returns to provide a space for free movement of the link part, for example, when the link part 7 returns, the second roller 3 will be unlocked. Particularly, when the operation part 6 elastically rebounds away from the link part 7, the link part 7 will be no longer limited by the operation part 6 and elastically rebound to return or the link part 7 will no longer limited by the operation part 6 and fall by self weight to return.

In this embodiment, the link part 7 is rotatably connected to the shell 1 and has a first end 72 and a second end 73. When the second roller 3 is locked, the first end 72 acts on the second roller 3. The operation part 6 acts on the second end 73 to unlock the second roller 3.

Wherein, the second roller 3 can be locked under direct control of the link part 7 and can also be locked by other lock parts, and the link part 7 controls the lock parts to lock or unlock the second roller. In this embodiment, the second roller 3 is locked and unlocked under the direct action of the link part 7. Specifically, in this embodiment, a force is applied to the operation part 6 to enable the operation part 6 to push against the second end 73, then the second end 73 moves upwards to drive the link part 7 to rotate, the first end 72 moves away from the second roller 3, so the second roller 3 is unlocked and can rotate, and at this moment, the wiper can be changed. When the force applied to the operation part 6 is stopped, the operation part 6 returns, the first end 72 locks the second roller 3 again, and the second roller 3 is fixed, so that the requirement for cleaning use is met.

In this embodiment, the operation part 6 may return by means of an elastic force provided by a first elastic part 41. The cleaning tool further comprises the first elastic part 41. When the force applied to the operation part 6 is stopped, the first elastic part 41 will apply a force to the operation part 6 to enable the operation part 6 to elastically return in the axial direction of the first roller 2, and the first elastic part 41 may be an elastic part, an elastic hook, or a spring. As another implementation, the operation part 6 is made of an elastic material such as rubber or silica gel. The operation part made of the elastic material is elastic and can generate a resilience force after being compressed, so that when the force applied to the operation part 6 is stopped, the operation part 6 will elastically return by means of self elasticity.

Specifically, when a force is applied to the second end 73, the first end 72 will be driven by the second end 73 to unlock/lock the second roller 3; when the force applied to the second end 73 is stopped, the first end 72 returns to lock/unlock the second roller 3 again. Wherein, the first end 72 may also return in such a manner that the first end 72 falls by means of self weight to lock/unlock the second roller 3 and then returns. Specifically, the first end 72 is located at an upper end of the second roller 3; when a force is applied to the first end 72, the first end 72 moves away from the second roller 3; and when the force applied to the first end 72 is stopped, the first end 72 falls by means of self weight to lock the second roller 3. Or, the first end 72 is located at a lower end of the second roller 3; when a force is applied to the first end 72, the first end 72 moves towards the second roller 3 to lock the second roller 3; when the force applied to the first end 72 is stopped, the first end 72 falls away from the second roller 3 by means of self weight so as to unlock the second roller 3. Or, an elastic force may be applied to the link part 7 to lock or unlock the second roller 3. Specifically, the cleaning tool further comprises a second elastic part 42. The second elastic part 42 is connected to the shell 1 and the link part 7 and applies a force to link part 7 to lock or unlock the second roller 3. In this embodiment, when a force is applied to the second end 73, the first end 72 will be driven by the second end 73 to unlock the second roller 3; and when the force applied to the second end 73 is stopped, the first end 72 will be driven by the second elastic part 42 to return to lock the second roller 3.

Preferably, the cleaning tool further comprises a rotary knob 5. The rotary knob 5 is rotatably connected to the shell 1 on one side of the first roller 2, and the rotary knob 5 and the shell 1 are limited in the circumferential direction. The operation part 6 is arranged between the rotary knob 5 and the shell 1.

When rotating under the effect of a force, the rotary knob 5 pushes the operation part 6 to move in the axial direction of the first roller 2, so that the link part 7 is driven to rotate to unlock the second roller 3; or, the rotary knob 5 drives the operation part 6 to rotate to drive the first roller 2 and the second roller 3 to rotate. In this way, unlocking control of the second roller 3 and rotation control of the first roller 2 are simplified into the rotation of the rotary knob 5, thus simplifying the control design and allowing the user to use the cleaning tool easily.

Preferably, the second end 73 and/or the operation part 6 are/is provided with a slope 73*a*. When the operation part 6 applies a force to the link part 7, the second end 73 enables the link part 7 to rotate under the effect of the slope 73*a*, and the first end 72 unlocks the second roller 3. In this embodiment, as shown in FIGS. 1-4, the second end 73 is provided with a downward slope 73*a*, and the operation part 6 has an abutting end 64 abutting against the slope 73*a*. The abutting end 64 moves towards the first roller 2 and pushes the slope 73*a* to move upwards, so the second end 73 is lifted. The abutting end 64 may be a bevel, and in this case, the abutting end 64 is in line connection with the slope 73*a*. Or, the slope 73*a* is disposed on the operation part 6, the bevel is disposed at the second end 73, and the slope pushes against the bevel to enable the operation part 6 to push the second end 73 to move. Further preferably, the abutting end 64 is also a slope, so that the contact area between the second end 73 and the operation part 6 is enlarged, and the second end 73 and the operation part 6 can be pushed by each other more uniformly and can interact with each other within a wider range.

In another aspect of this embodiment, the second end 73 is located at an upper end of the operation part 6, and correspondingly, the first end 72 is located below the second roller 3. Or, the second end 73 is located at a lower end or the upper end of the operation part 6, and the first end 72 is located above or below the second roller 3. All these transformations should also fall within the protection scope of the invention.

Preferably, the rotary knob 5 and/or the operation part 6 are/is provided with a slope. When the rotary knob 5 rotates, the operation part 6 moves away from the rotary knob 5 under the effect of the slope. In this embodiment, the rotary knob 5 and the operation part 6 are both provided with slopes, so that the contact area between the rotary knob 5 and the operation part 6 is enlarged, and the rotary knob 5 and the operation part 6 can be pushed by each other more uniformly and can interact with each other within a wider range.

Specifically, the shell 1 is formed with an anti-rotation groove 11. The rotary knob 5 is circular. First protrusions 51 and slopes 52 are arranged on an inner wall of the rotary knob 5. The operation part 6 is provided with anti-rotation protrusions 61, second protrusions 62 and slopes 63.

During specific implementation, the anti-rotation protrusions are embedded in the anti-rotation groove 11, so the movement of the operation part 6 in the circumferential direction is limited; when the rotary knob 5 rotates, the slopes 52 of the rotary knob push against the slopes 63 of the operation part 6, and the operation part 6, the movement of which in the circumferential direction has been limited, moves linearly away from the rotary knob 5. When the operation part 6 moves linearly away from the rotary knob 5, the anti-rotation protrusions 61 disengage from the anti-rotation groove 11 to release the operation part 6 in the circumferential direction; the rotary knob 5 continues to rotate, the first protrusions 51 push against the second protrusions 62, and the operation part 6 is driven. The operation part 6 is connected to the first roller 2 and can rotate to drive the first roller 2 to rotate.

Specifically, the operation part 6 and the first roller 2 are mutually limited in the rotation direction and the circumferential direction, so when the operation part 6 rotates, the first roller 2 will be driven to rotate; or, force transmission between the operation part 6 and the first roller 2 is realized by gear drive. Wherein, in the case where the operation part 6 and the first roller are mutually limited in the rotation direction and the circumferential direction, a circumferential limiting structure of the first roller 2 may be arranged for the operation part 6, or a circumferential structure of the operation part 6 may be arranged for the first roller 2, or both the circumferential structure of the operation part 6 and the circumferential structure of the first roller 2 may be arranged for the rotary knob 5. All these common transformations made by those skilled in the art should fall within the protection scope of the invention.

Preferably, the anti-rotation protrusions 61 are gear teeth formed on an outer edge of the operation part 6, and tooth sockets corresponding to the gear teeth on the outer edge of the operation part 6 are formed in the anti-rotation grooves 11.

Preferably, the first roller 2 can rotate with respect to the shell 1 in one direction. The direction during cleaning is opposite to the direction when the wiper is changed, so that fixed control of the first roller 2 can be simplified. The structure for unidirectional rotation includes common techniques in the prior art.

Preferably, a ratchet unidirectional movement mechanism is arranged between the first roller 2 and the shell 1 and comprises a ratchet 21 and a first pawl 22 rotating along the ratchet 21. When the ratchet unidirectional movement mechanism acts on the first roller 2, the first roller 2 links with the rotary knob 5, and the operation part 6 links with the rotary knob 5, so that the rotation of the rotary knob 5 and the operator 6 will also be limited in one direction.

A round hole is formed in the side wall of the shell 1, the ratchet 21 is circumferentially arranged along the round hole, and the first pawl 22 is fixedly connected to the first roller 2 and is surrounded by the ratchet 21.

The first pawl 22 comprises an arc piece 22*a* and a disk 22*b*, wherein the arc piece 22*a* is fixedly arranged on the periphery of the disk 22*b*, a sharp tooth is formed at a far end of the arc piece 22*a*, and the disk 22*b* is fixedly connected to the first roller 2.

Preferably, tooth sockets of the ratchet 21 correspond to the tooth sockets of the anti-rotation groove 11, so that when the operation part 5 disengages from the anti-rotation groove 11 to rotate, every time the operation part 6 rotates by one gear tooth, the next adjacent gear tooth will still be in correspondence with the tooth socket of the anti-rotation groove 11 under the limitation of the tooth sockets of the ratchet 21, and when the force applied to the rotary knob 5 is stopped, the operation part 6 will move away from the first roller 2 and exactly return into the anti-rotation groove 11.

In another implementation, the shell 1 is provided with a pawl elastic part 13 and a second pawl 14. The pawl elastic part 13 forces the second pawl 14 to abut against the gear teeth formed on the outer edge of the operation part 5, so when unidirectional rotation of the operation part 6 in the circumferential direction is limited, unidirectional rotation of the rotary knob 5 and the first roller 2 in the circumferential direction will also be limited. Preferably, teeth sockets of the second pawl 14 are identical with the tooth sockets of the anti-rotation groove 11, so that when the operation part 6 disengages from the anti-rotation groove 11 to rotate, every time the operation part 6 rotates by one gear tooth, the next adjacent gear tooth will be still in correspondence with the tooth socket of the anti-rotation groove 11 under the limitation of the second pawl 14; and when the force applied to the rotary knob 5 is stopped, the operation part 6 will moves away from the first roller 2 and exactly return into the anti-rotation groove 11.

Wherein, in this embodiment, the specific structure at the first end 72 is as follows: a gear 32 is arranged at one end of the second roller 3, and a tooth surface engaged with the gear 32 is formed at the first end 72. When the tooth surface is engaged with the gear 32, the second roller 3 will be locked; and when the tooth surface is separated from the gear 32, the second roller 3 can rotate. The tooth-to-tooth engagement design makes the structure simple and matches the overall design of this embodiment. Of course, the first end 72 may also lock the second roller 3 through the following structure: the first end 72 is inserted into the second roller 3 as a bolt to form an inserted matching mechanism; or, a clamping surface is formed at the first end 72 to clamp the second roller 3 therein. All these common locking means adopted by those skilled in the art should fall within the protection scope of the invention.

Figure 5:
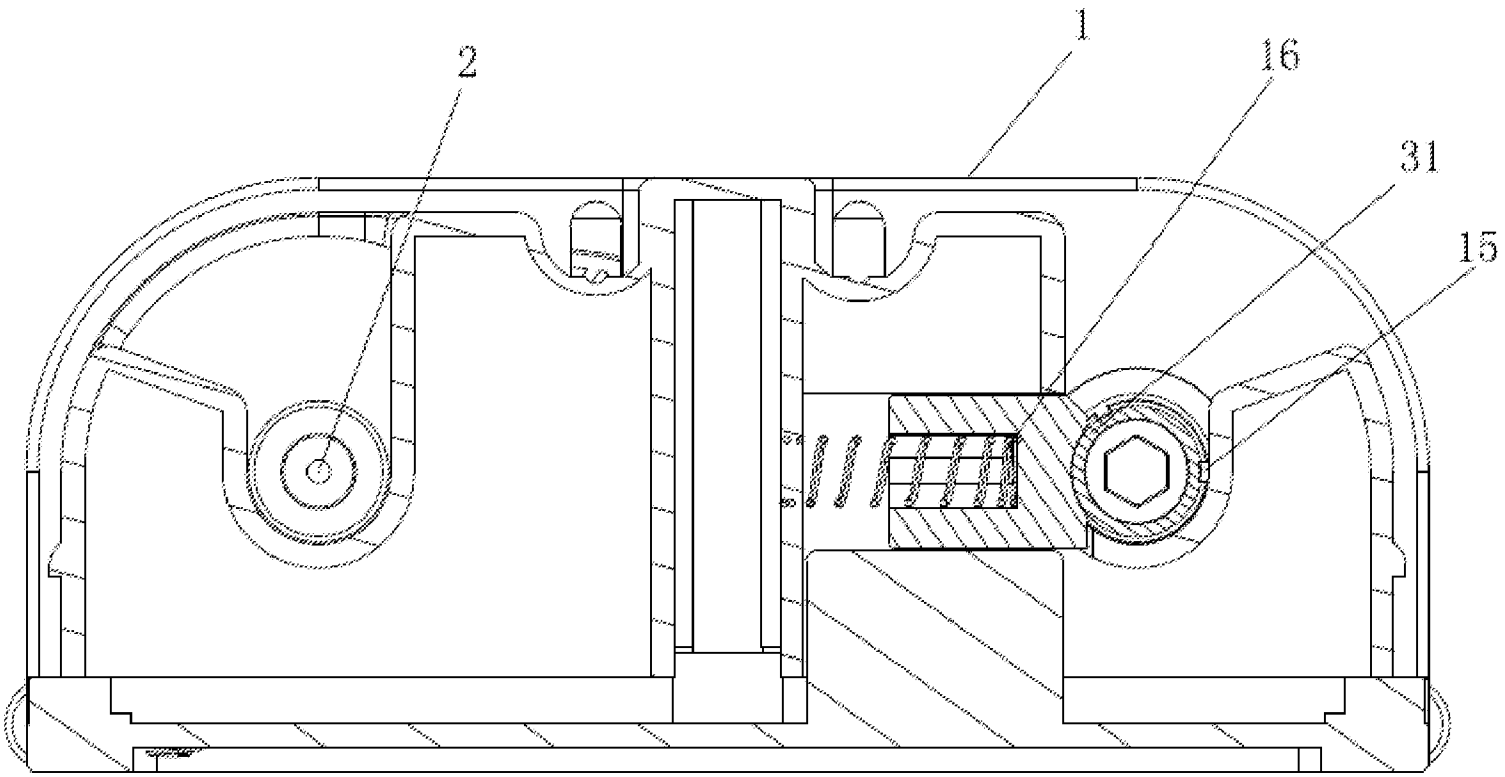
FIG. 5 is a sectional view from another perspective of the invention.

Preferably, as shown in FIG. 5, a circular shaft 31 is arranged at an end, away from the link part 7, of the second roller 3, a slot 15 allowing the circular shaft 31 to fall therein is formed in the shell 1, and the circular shaft 31 can rotate in the slot 15. The shell 1 is further provided with an elastic block 16, and an abutting surface is formed between the elastic block 16 and the side wall of the circular shaft 31. The second roller 3 is used as a driven roller and may continue to rotate under the inertia effect at the moment the wiper has been changed, which in turn causes looseness of the wiper and inconvenience during cleaning; and the elastic block 16 abuts against the circular shaft 31, so that inertia rotation of the second roller 3 is effectively limited to ensure that the wiper can be kept in a tensioned state after change.

In this embodiment, the shell 1 is provided with a hole 17, a button 18 and a third elastic part 19. A drive rod 23 to be embedded in the hole 17, and a fourth elastic part 24 are arranged at one end of the first roller 2. The other end of the first roller 2 is rotatably connected to the other side of the shell 1. The button 18 pushes against the drive rod 23. The drive rod 23 is movably arranged in an axial direction of its own, and the fourth elastic part 24 abuts against the drive rod 23. The button 18 is movably arranged in an axial direction of its own, and the third elastic part 19 abuts against the button 18.

When the first roller 2 is mounted in the shell 1, the drive rod 23 moves towards the hole 17, the fourth elastic part 24 is compressed until the drive rod 23 is embedded in the hole 17 and then returns to push against the button 18. The button 18 pushes against the drive rod 23 under the effect of a force, and the fourth elastic part 24 is compressed until the drive rod 23 disengages from the hole 17, so that the first roller 2 can be disassembled conveniently. When the force applied to the button 18 is stopped, the button 18 returns under the effect of the third elastic part 19.

In this embodiment, the rotary knob 5 is disposed around the button 18, and the rotary knob 5, the button 18, the first roller 2 and the operation part 6 are coaxially arranged, so that disassembly of the first roller 2, changing and replacement of the wiper and maintaining of the cleaning state of the cleaning tool can be performed at the same operation point, the structure is simple, and using is convenient.

During specific operation, the rotary knob 5 rotates under the effect of a force to push the operation part 6 to move towards the first roller 2 in the axial direction of the first roller 2, in this process, the operation part 6 is limited in the anti-rotation groove 11 to be prevented against rotation, a force is applied to the first elastic part 41, the operation part 6 pushes the second end 73 to rotate, the first end 72 moves away from the second roller 3 to unlock the second roller 3, and a force is applied to the second elastic part 42. The operation part 6 moves towards the first roller 2 until the operation part 6 moves towards the first roller 2 until the operation part 6 disengages from the anti-rotation groove 11, the rotary knob 5 continues to rotate under the effect of a force to drive the operation part 6 to rotate, the operation part 6 drives the first roller 2 to rotate, the first roller 2 drives the second roller 3 to rotate through the wiper, so that the wiper can be changed. When the force applied to the rotary knob 5 is stopped, the first elastic part 41 rebounds and pushes the operation part 6 to move away from the first roller 2, the operation part 6 returns to be limited in the anti-rotation groove 11, the second elastic part 42 rebounds and pushes against the first end 72 to lock the second roller 3, and at this moment, the cleaning tool can be used for cleaning.

The above contents in the specification are merely used to explain the invention by way of example. Different modifications, supplements or similar substations of the above-mentioned specific embodiments made by those skilled in the art without departing from the contents in the specification or going beyond the scope defined by the appended claims should also fall within the protection scope of the invention.

What is claimed is:

1. A cleaning tool, comprising a first roller, a second roller, a shell and a wiper, wherein the first roller is rotatably connected to the shell, the second roller is rotatably connected to the shell, two ends of the wiper are wound around the first roller and the second roller, respectively, wherein the cleaning tool further comprises an operation part and a link part, and the operation part moves in an axial direction of the first roller to control the link part to unlock the second roller and the operation part rotates to drive the first roller to rotate.

2. The cleaning tool according to claim 1, wherein the link part is rotatably connected to the shell;

when the second roller is locked, a first end of the link part acts on the second roller; and the operation part acts on a second end of the link part to unlock the second roller.

3. The cleaning tool according to claim 2, wherein the second end of the link part and the operation part are provided with a slope; and the operation part applies a force to the link part, the second end of the link part enables the link part to rotate under an effect of the slope, and the first end of the link part unlocks the second roller.

4. The cleaning tool according to claim 2, wherein a gear is arranged at an end of the second roller, and a tooth surface engaged with the gear is formed at the first end of the link part.

5. The cleaning tool according to claim 1, further comprising a first elastic part, wherein the first elastic part applies a force to the operation part to enable the operation part to return.

6. The cleaning tool according to claim 5, further comprising a second elastic part, wherein the second elastic part is connected to the shell and the link part, and the second elastic part applies a force to the link part to enable the link part to lock or unlock the second roller.

7. The cleaning tool according to claim 1, wherein the operation part is elastic and returns by a self-elasticity.

8. The cleaning tool according to claim 1, further comprising a rotary knob, wherein the rotary knob is rotatably connected to the shell on a side of the first roller, and the rotary knob and the shell are limited in a circumferential direction;

when a force is applied to the rotary knob, the rotary knob pushes the operation part to move towards the first roller or drives the operation part to rotate.

9. The cleaning tool according to claim 8, wherein the rotary knob and the operation part are provided with a slope; and when the rotary knob rotates, the operation part moves in the axial direction of the first roller under an effect of the slope to trigger the link part.

10. The cleaning tool according to claim 9, wherein the rotary knob is circular, and the rotary knob is provided with a first protrusion, and the operation part is provided with a second protrusion;

the shell is connected to an anti-rotation groove, and the operation part is provided with anti- rotation protrusions;

the anti-rotation protrusions are embedded in the anti-rotation groove;

when the rotary knob rotates, the operation part moves linearly away from the rotary knob under the effect of the slope; and the anti-rotation protrusions disengage from the anti-rotation groove, the rotary knob continues to rotate, the first protrusion pushes against the second protrusion, and the rotary knob drives the operation part to rotate.

11. The cleaning tool according to claim 10, wherein the anti-rotation protrusions are gear teeth formed on an outer edge of the operation part, and tooth sockets corresponding to the gear teeth on the outer edge of the operation part are formed in the anti-rotation groove.

12. The cleaning tool according to claim 11, wherein a ratchet unidirectional movement mechanism is arranged between the first roller and the shell and the ratchet unidirectional movement mechanism comprises a ratchet and a first pawl, the first pawl rotates along the ratchet, and tooth sockets of the ratchet correspond to tooth sockets of the anti-rotation groove.

13. The cleaning tool according to claim 11, wherein the shell is provided with a pawl elastic part and a second pawl, and the pawl elastic part forces the second pawl to abut against the gear teeth formed on the outer edge of the operation part.

14. The cleaning tool according to claim 11, wherein the shell is provided with a pawl elastic part and a second pawl, the pawl elastic part forces the second pawl to abut against the gear teeth formed on the outer edge of the operation part, and tooth sockets of the second pawl are identical with tooth sockets of the anti-rotation groove.

15. The cleaning tool according to claim 1, wherein the first roller rotates with respect to the shell unidirectionally.

16. The cleaning tool according to claim 15, wherein a ratchet unidirectional movement mechanism is arranged between the first roller and the shell and the ratchet unidirectional movement mechanism comprises a ratchet and a first pawl, and the first pawl rotates along the ratchet.

17. The cleaning tool according to claim 16, wherein a round hole is formed in a side wall of the shell, the ratchet is circumferentially arranged along the round hole, and the first pawl is fixedly connected to the first roller and is surrounded by the ratchet.

18. The cleaning tool according to claim 17, wherein the first pawl comprises an arc piece and a disk, the arc piece is fixedly arranged on a periphery of the disk, a sharp tooth is formed at a far end of the arc piece, and the disk is fixedly connected to the first roller.

19. The cleaning tool according to claim 1, wherein a circular shaft is arranged at an end, away from the link part, of the second roller, a slot allowing the circular shaft to fall in the slot is formed in the shell, and the circular shaft rotates in the slot; and the shell is further provided with an elastic block, and an abutting surface is formed between the elastic block and a side wall of the circular shaft.

20. The cleaning tool according to claim 1, wherein the shell is provided with a hole, a button and a third elastic part;

a drive rod is embedded in the hole, and the drive rod and a fourth elastic part are arranged at a first end of the first roller;

a second end of the first roller is rotatably connected to a side of the shell;

the button pushes against the drive rod;

the drive rod is movably arranged in an axial direction of the drive rod, and the fourth elastic part abuts against the drive rod;

the button is movably arranged in an axial direction of the button, the third elastic part abuts against the button;

when the first roller is mounted in the shell, the drive rod moves towards the hole, and the fourth elastic part is compressed until the drive rod is embedded in the hole and then rebounds to push against the button; and when a force is applied to the button, the button pushes against the drive rod, and the fourth elastic part is compressed until the drive rod disengages from the hole.

* * * * *